US006786983B2

(12) United States Patent
Szymanowski et al.

(10) Patent No.: US 6,786,983 B2
(45) Date of Patent: Sep. 7, 2004

(54) CASTING PROCESS AND PRODUCT

(75) Inventors: Richard Brian Szymanowski, Saint Joseph, MI (US); Rathindra DasGupta, Portage, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/100,054

(22) Filed: Mar. 19, 2002

(65) Prior Publication Data

US 2003/0180178 A1 Sep. 25, 2003

(51) Int. Cl.[7] ..... C22C 21/02
(52) U.S. Cl. ..... 148/416; 148/438; 420/537
(58) Field of Search ..... 148/416, 438; 420/537, 538

(56) References Cited

U.S. PATENT DOCUMENTS 4,808,374 A * 2/1989 Awano et al. ..... 420/537

FOREIGN PATENT DOCUMENTS

EP 0400059 12/1990

OTHER PUBLICATIONS

"Aluminum and Aluminum Alloys", ASM International, 1993, pp 292, 296–298, 315–317, 723–724.*

Yoshida, et al., "The Effect of Hydrogen in Molten Aluminum on the Growth of Micro–Porosity and Mechanical Properties of Squeeze Cast Material", Journal of Japan Institute of Light Metals, vol. 50, No. 7, 2000, pp. 325–329.

Database Metadex Online! Materials Information, The Institute of Metals, London, GB; Tang, D. (Shanghai University) et al., "Discussion on some technological aspects for aluminum alloy in squeeze casting", retrieved from STN, Database accession No. 51–712, XP002250147, abstract & Tezhong Zuzai Ji Youse Hejin (Special Casting & Nonferrous Alloys) (China) (Oct.–Dec. 2002), 28–29, 3 Ref, ISSN: 1001–2249.

W. Hufanagel, "Key to Aluminum Alloys 4$^{th}$ Edition", 1992, Aluminum Verlag GMBH, Düsseldorf, XP002250146, 387017, p. 62.

* cited by examiner

*Primary Examiner*—Roy King
*Assistant Examiner*—Janelle Combs Morillo
(74) *Attorney, Agent, or Firm*—Baker & Hostetler LLP

(57) ABSTRACT

An aluminum alloy product is provided that includes an ADC12 aluminum alloy, wherein the ADC12 aluminum alloy is cast into the product utilizing a high pressure, slow velocity casting technique.

18 Claims, 2 Drawing Sheets

CASTING PROCESS AND PRODUCT

FIELD OF THE INVENTION

The present invention relates generally to casting processes and casting alloys. More particularly, the present invention is directed to an aluminum alloy for use with a high pressure casting technique.

BACKGROUND OF THE INVENTION

It is conventional in the casting industry to produce products that require high strength, wear resistance, hardness, and/or ductility, using aluminum alloys, such as 356 secondary and A356.2, in conjunction with the gravity permanent mold (GPM) casting process. The GPM casting technique involves heating a metal and pouring the molten metal into permanent metal molds while allowing gravity to fill the mold cavity with the molten metal. The primary difference between permanent mold casting and conventional die casting, which is high pressure and high velocity casting, is that the molten metal is simply poured into the mold without any external mechanical forces, rather than injected into a die, as is done in conventional die casting. Typically, products manufactured by the GPM casting technique tend to be higher in strength and are less porous than products produced by conventional die casting.

The mechanical properties of a product are not only dependent on the casting technique utilized, but are also dependent on the casting alloy that is utilized. Aluminum alloys are commonly used in the casting industry because they are adaptable to many of the most commonly used casting methods, can readily be cast in metal molds or dies and have a high resistance to corrosion.

As a casting material, aluminum alloys also provide good fluidity, i.e., most aluminum alloys flow with ease. This is particularly important because if the metal, when in its molten state, does not flow at a rate that is sufficient to fill the die cavity or mold before the molten metal solidifies, then the metal may have difficulty filling, for example, thin sections of a mold or die.

Additionally, aluminum alloys have relatively low melting points. Accordingly, the heat required to melt aluminum alloys is less than the heat required for some metals and thus, the cost of producing aluminum alloy castings is less. Further, there is less heat to transfer from the molten aluminum alloy to the mold. As a result, the cycle time required for casting an aluminum alloy product is reduced. In addition, the lifetime of the mold is increased by utilizing aluminum alloys because the molds are subjected to less stress from heat.

In particular, the 356 secondary and A356.2 aluminum alloys are commonly used with the GPM casting technique to produce products requiring high strength, wear-resistance, hardness and/or ductility. The chemistries of the 356 secondary and A356.2 aluminum alloys are as follows:

| A356.2 | | 356 Secondary | |
|---|---|---|---|
| Element | Percent of Weight | Element | Percent of Weight |
| Silicon | 6.5–7.5 | Silicon | 6.5–7.5 |
| Iron | 0.12 max | Iron | 0.6 max |

-continued

| A356.2 | | 356 Secondary | |
|---|---|---|---|
| Element | Percent of Weight | Element | Percent of Weight |
| Manganese | 0.05 max | Manganese | 0.35 max |
| Magnesium | 0.30–0.45 | Magnesium | 0.20–0.45 |
| Zinc | 0.50 max | Zinc | 0.35 max |
| Titanium | 0.20 max | Titanium | 0.25 max |
| Strontium | 0.03 max | Strontium | 0.03 max |
| Copper | 0.10 max | Copper | 0.25 max |
| Other | 0.15 max | Other | 0.15 max |
| Aluminum | Balance | Aluminum | Balance |

However, there are specific problems associated with the 356 secondary and A356.2 aluminum alloys when utilized as a casting metal. For example, the casting melting temperature of 356 secondary and A356.2 is approximately 1320 degrees Fahrenheit (715.5 degrees Celsius). When castings are produced with the alloys having a casting metal temperature of 1320 degrees Fahrenheit, soldering occurs. Soldering refers to the adherence of aluminum to the cavity of a mold or die, which, after a period of time, renders the mold or die unusable.

It is common in the automotive industry to produce master cylinders and components of antilock braking systems (ABS) from the 356 secondary and A356.2 aluminum alloys using GPM. Braking systems are utilized to reduce a vehicle's speed, to bring the vehicle to a stop, or to keep the vehicle stationary if the vehicle is already at rest. The master cylinder is one of the control devices for braking systems in vehicles, such as passenger cars and light utility vehicles that is utilized to apply pressure to the wheel cylinders. ABS components are control devices within a braking system that prevent wheel lock-up during braking by controlling force to the wheel cylinders to maintain stability of the vehicle.

Accordingly, because of the purposes for which master cylinders and ABS components serve, they are required to have high mechanical properties in the areas of strength, wear resistance and hardness. Further, ABS components also are required to be ductile, i.e., has the ability to undergo permanent deformation prior to failure.

Typically, subsequent to the casting of master cylinders and/or ABS components, the master cylinders and/or ABS components are heat treated for increased strength and hardness, and anodized for increased corrosion resistance. The products are heat treated to deliver the minimum property requirements for the required components as shown below:

Minimum Properties for master cylinders:
- Yield strength=~23 ksi
- Tensile strength=~35 ksi
- Percent elongation=~1%
- Hardness=~80 BHN Minimum properties for ABS components:
- Yield strength=~25 ksi
- Tensile strength=~35 ksi
- Percent elongation=~3%
- Hardness=~80 BHN Master cylinders and ABS components produced utilizing GPM and 356 secondary and A356.2 aluminum alloys are typically heat treated to ensure that the products satisfy the minimum property requirements for the respective product. Commonly, master cylinders are heat treated according to a T6 temper. A typical T6 temper consists of solution treating the casting at 1,000 degrees Fahrenheit (537.7 degrees Celsius) plus or minus ten degrees Fahrenheit for ten hours, water quenching the casting, and artificially aging the casting at 340 degrees Fahrenheit (171.1 degrees Celsius) plus or minus ten degrees Fahrenheit for four to five hours.

SUMMARY OF THE INVENTION

Accordingly, it is desirable to provide, at least to some extent, a casting product, which exceeds in mechanical properties and costs, casting products manufactured according to the GPM casting technique utilizing the 356 secondary or A356.2 aluminum alloys.

In one aspect of the invention, an aluminum alloy product is provided that includes an ADC12 aluminum alloy, wherein the ADC12 aluminum alloy is cast into the product utilizing a high pressure, slow velocity casting technique.

In another aspect of the present invention, a braking system is provided that includes a brake component, wherein the brake component is made from an ADC12 aluminum alloy, and wherein the ADC12 aluminum alloy is cast into a brake component according to a high pressure, slow velocity casting technique.

In yet another aspect of the present invention, a method for manufacturing an aluminum alloy component is provided that includes injecting an ADC12 aluminum alloy into a die and applying a high pressure, slow velocity casting technique.

In another aspect of the present invention, a casting apparatus is provided that includes a means for injecting an ADC12 aluminum alloy into a die, and a means for applying a high pressure casting technique.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS OF THE INVENTION

Figure 1:
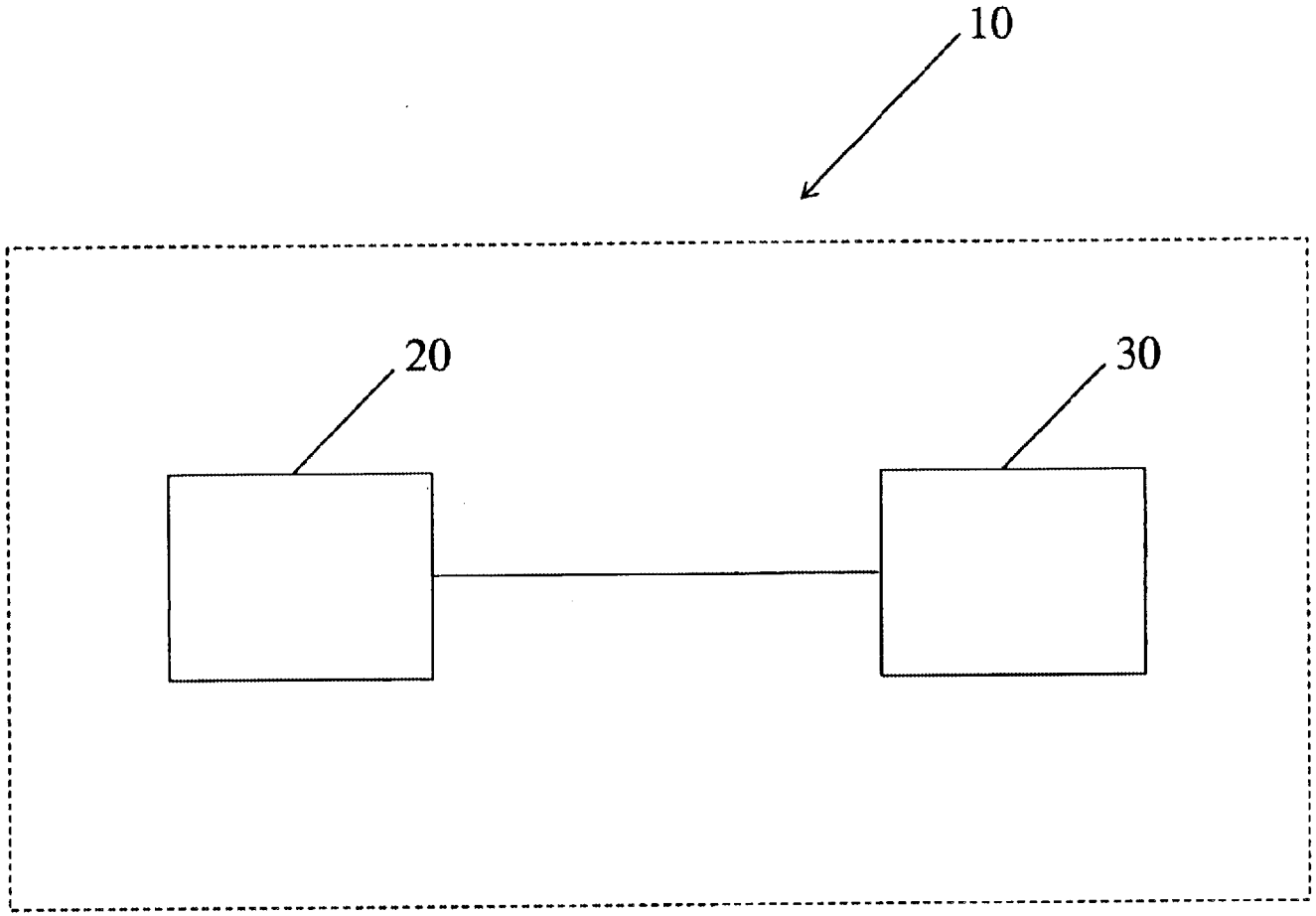
FIG. 1 schematically illustrates parts of a braking system in accordance with the present invention.

In accordance with the present invention, an aluminum alloy, ADC12, is utilized with a high pressure, slow velocity casting technique to produce casting products, such as master cylinders and ABS components.

High pressure, slow velocity casting techniques, such as squeeze casting, involve injecting molten metal into a mold via a hydraulically powered piston, at a slow rate into the mold/die cavity, and applying and maintaining a high pressure until after the metal has solidified in the mold/die cavity. When the applied high pressure thrusts the molten metal to the walls of the mold/die cavity, the air gap between the molten metal and the walls of the mold/die cavity is quickly minimized. Accordingly, there is a rapid transfer of heat between the metal and the mold/die cavity.

Consequently, because use of the rapid heat transfer process involved in high pressure casting, the metal cools to a solid state quickly. As a result of the rapid solidification, the grain structure of the casting is small, i.e., refined.

When the ADC12 alloy is utilized with a high pressure, slow velocity casting technique to cast, for example master cylinders and ABS components, the resulting castings exhibit mechanical properties that are higher than the mechanical properties of products manufactured according to GPM casting techniques utilizing the 356 secondary and A356.2 aluminum alloys. ADC12 is composed of the below-listed elements, by percentage of weight, as follows:

| Element | Percentage of Weight |
|---|---|
| Silicon | 9.6–12.0 |
| Iron | 0.–1.3 |
| Copper | 1.5–3.5 |
| Manganese | 0–0.5 |
| Magnesium | 0–0.3 |
| Zinc | 0–1.0 |
| Nickel | 0–0.5 |
| Tin | 0–0.3 |
| Other | 0–0.15 |
| Aluminum | Remainder |

As shown from the chart immediately above, the ADC12 aluminum alloy does not require strontium. Strontium is utilized in an aluminum alloy as a modifying agent to, for example, improve the ductility of the aluminum alloy. Strontium is often utilized along with casting processes that involve slower solidification rates, such as GPM and sand casting. The ADC12 alloy, when utilized with a high pressure, slow velocity casting technique, has a higher solidification rate because of the rapid heat transfer rates that are characteristic of high pressure casting techniques. Thus, because the products derive high ductility from being manufactured according to a high pressure, slow velocity casting technique, there is not a need for strontium with the use of ADC12 alloy. As a result, the aluminum content is increased in ADC12 alloy products. The cost of the aluminum is cheaper than the cost of strontium. Accordingly, the cost of ADC12 alloy products is cheaper alloys, such as A356.2 and 356 secondary that contain strontium.

The ADC12 alloy has a silicon content of 9.6 to 12.0 percent of its weight and is higher than the silicon content of both the A356.2 and 356 secondary aluminum alloys, which is 6.5 to 7.5 percent of its weight. The higher silicon content of the ADC12 alloy leads to the ADC12 alloy having a metal casting temperature of 1250 degrees Fahrenheit (676.6 degrees Celsius). The metal casting temperature of the 356 secondary and A356.2 aluminum alloys is approximately 1320 degrees Fahrenheit (715.5 degrees Celsius). Accordingly, less energy is required to melt the ADC12 alloy than is required to melt the 356 secondary and A356.2 alloys. Thus, the cost associated with manufacturing ADC12 products is less than the cost associated with manufacturing 356 secondary and A356.2 products.

Additionally, the lower metal casting temperature of the ADC12 alloy leads to approximately thirty-five percent less dross formation than that produced by the 356 secondary and A356.2 aluminum alloys. Dross refers to the metal oxide that is formed when the molten metal reacts with air. Dross formation typically occurs before the molten metal is transferred to the mold/die cavity. If the dross enters the mold/die cavity and becomes a part of the casting, it can lead to a defective casting because the casting will not consist purely of the intended alloy.

Additionally, the lower metal casting temperature and the higher iron content of the ADC12 alloy lead to less occurrences of soldering, approximately fifteen percent less, than that produced by the 356 secondary and A356.2 aluminum alloys. Soldering refers to the adherence of aluminum from the alloy to the mold or die cavity. Over a period of time the occurrences of soldering reduce the usability of the mold. Accordingly, utilizing the ADC12 alloy over the 356 secondary and A356.2 alloys reduces soldering and prolongs the life of the mold/die cavity.

When a T6 temper consisting of solution treating the molten metal at 932 degrees Fahrenheit (500 degrees Celsius) plus or minus ten degrees Fahrenheit for four hours, water quenching the molten metal, and artificially aging the metal at 356 degrees Fahrenheit (180 degrees Celsius) plus or minus ten degrees Fahrenheit for five hours was applied to the ADC 12 alloy, the ADC12 alloy outperformed the A356.2 and 356 secondary alloys in yield strength and tensile strength when a comparable T6 temper was applied to the A356.2 and 356 secondary alloys. The resulting yield strength, tensile strength, and elongation properties of the A356.2, 356 secondary and ADC12 alloys are as follows:

| Alloy | Yield strength | Tensile strength | Elongation |
|---|---|---|---|
| A356.2-T6 (GPM) | 30–33 ksi | 40–44 ksi | 3–5% |
| 356 secondary-T6 (GPM) | 33–35 ksi | 39–42 ksi | 3–5% |
| ADC12-T6 High Pressure | 43–46 ksi | 55–61 ksi | 3–5% |

It is evident from the chart above that the ADC12 alloy has a higher tensile strength than the 356 secondary and A356.2 aluminum alloys. The tensile strength corresponds to the maximum load bearing ability of the metal before the metal breaks down. Thus, the ADC12 alloy has a higher resistance to applied forces. The higher strength of the ADC12 alloy is attributed, at least in part, to the refined microstructure, i.e., the smaller grain size of the casting that is developed from use of a high pressure, slow velocity casting technique. Accordingly, the ADC12 alloy is stronger than the 356 secondary and A356.2 aluminum alloys and therefore, is more suitable for products requiring high strength, for example, components of braking systems, such as master cylinders and ABS components. FIG. 1 schematically illustrates a braking system 10 having a master cylinder 20 and an ABS component 30.

Further, when the T6 temper was applied to the ADC12 alloy, the ADC12 alloy outperformed the A356.2 and 356 secondary alloys in wear resistance, which is measured in terms of volume loss of material based on standards established by the American Society for Testing of Materials ASTM G-77, as follows:

| Alloy | Wear Resistance (Volume Loss of Material) |
|---|---|
| A356.2-T6 (GPM) | (25.5 to 40.56) × $10^{-6}$ cu.in |
| 356 secondary-T6 (GPM) | (19.5 to 35) × $10^{-6}$ cu.in |
| ADC12-T6 High Pressure | (7.48 to 11.55) × $10^{-6}$ cu.in |

Thus, when the ADC12 alloy was subjected to the ASTM G-77 procedures, which involve measurement of volume loss of aluminum alloy by subjecting the aluminum alloy to a rotating cast iron disc for a prescribed period of time, the ADC12 alloy lost less material than the A356.2 and 356 secondary alloys. The higher wear resistance, i.e., lower volume loss of material is attributed, at least in part, to the refined microstructure, i.e., the smaller grain size of the casting that is developed from use of high pressure, slow velocity casting technique. Typically, products, for example, master cylinders and ABS components are anodized to increase the wear resistance of those products. By utilizing the ADC12 alloy in conjunction with a high pressure casting technique, the amount of anodizing necessary to apply to products is reduced or eliminated.

In addition, ADC12 has a maximum iron content of 1.3 percent of its weight that is higher than the iron content of the 356 secondary and A356.2 alloys, which are a maximum of 0.6 and 0.12 percent of their weight, respectively. When the iron content of an ADC12 casting is greater than the maximum iron content of an 356 secondary or A356.2 alloys, the ADC12 product will be easier to machine than an A356.2 product and/or 356 secondary product. The high iron content of the ADC12 alloy product facilitates chip formation, i.e., the generation of shavings, as the product is machined. Accordingly, less force or pressure has to be applied to the machine tool when feeding/thrusting the machine/cutting tool onto the ADC12 alloy product to make the initial cut into the ADC12 product, and also when cutting the ADC12 alloy product, than when performing the same actions on 356 secondary and A356.2 alloy products. Accordingly, the machine/cutting tool is subjected to less stress and the lifetime of the machine/cutting tool is prolonged with the ADC12 alloy.

Further, the cost of ADC12 alloy stock/ingots is cheaper than the cost of A356.2 aluminum alloy and 356 secondary alloy stock/ingots by approximately ten cents per pound.

Figure 2:
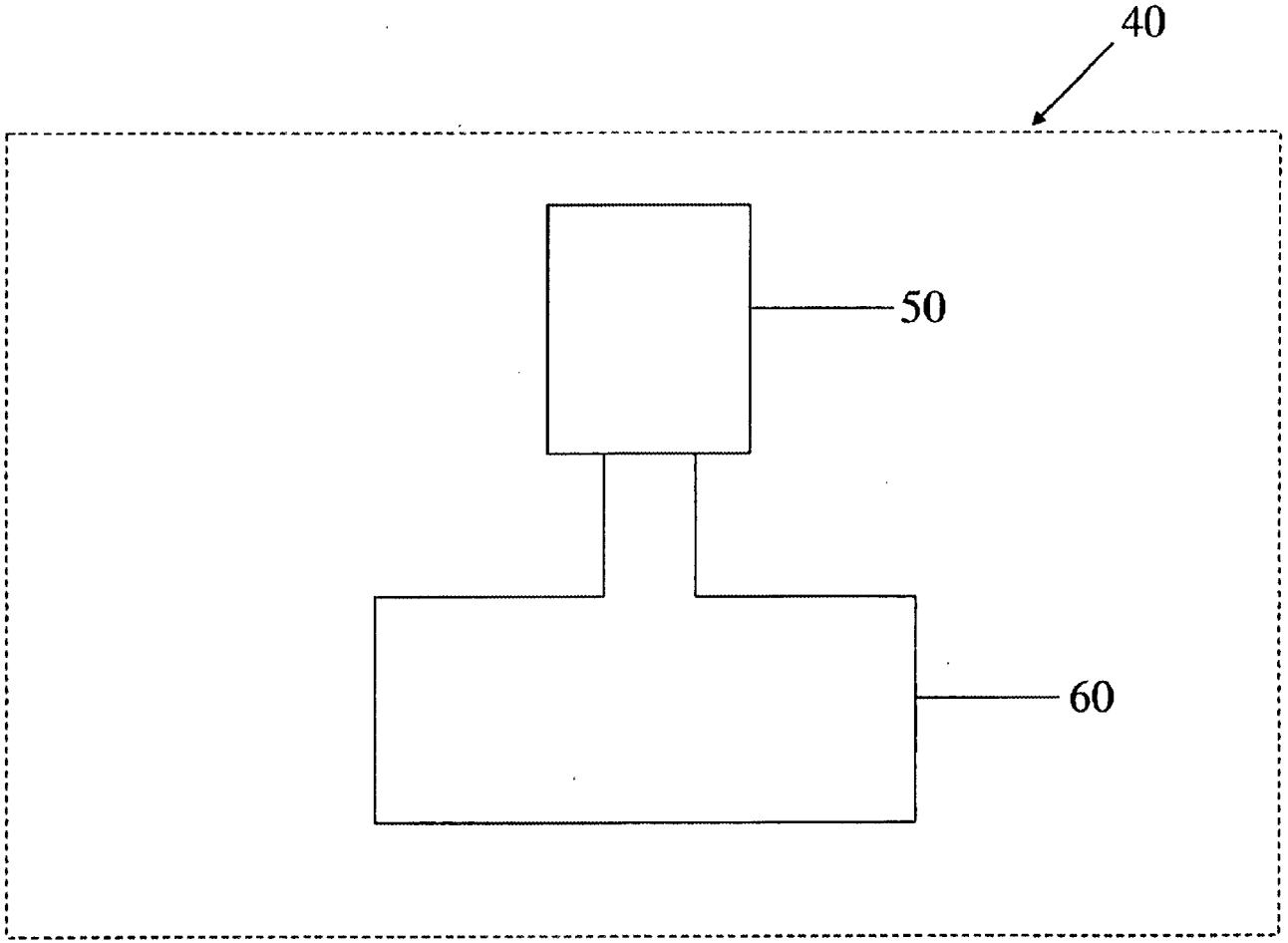
FIG. 2 schematically illustrates a casting apparatus in accordance with the present invention.

Accordingly, when the ADC12 alloy is utilized in conjunction with a high pressure casting technique to manufacture products, for example, master cylinders and ABS components, the products have high mechanical properties and are cheaper to produce. FIG. 2 schematically illustrates a casting apparatus 40 utilizing a high pressure casting technique including a piston assembly 50 and a mold/die 60.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to as falling within the scope of the invention.

What is claimed is:

1. A brake product comprising:

an ADC12 aluminum alloy, wherein the ADC12 aluminum alloy is cast into said brake product utilizing a high pressure, slow velocity casting technique, wherein the ADC12 aluminum alloy consists essentially of the following constituents by percentage of weight:

| | |
|---|---|
| 9.6 to 12.0 | percent silicon; |
| 0.0 to 1.3 | percent iron; |
| 0.0 to 0.5 | percent manganese; |
| 0.0 to 0.3 | percent magnesium; |
| 0.0 to 1.0 | percent zinc; |
| 0.0 to 0.5 | percent nickel; |
| 0.0 to 0.3 | percent tin; |
| 1.5 to 3.5 | percent copper; |
| 0.0 to 0.15 | percent one or more other elements; and aluminum as the remainder; |

9.6 to 12.0 percent silicon; 0.0 to 1.3 percent iron; 0.0 to 0.5 percent manganese; 0.0 to 0.3 percent magnesium; 0.0 to 1.0 percent zinc; 0.0 to 0.5 percent nickel; 0.0 to 0.3 percent tin; 1.5 to 3.5 percent copper; 0.0 to 0.15 percent one or more other elements;

and wherein the brake product has a tensile strength of about 55–61 ksi.

2. The brake product of claim 1, wherein a heat treatment is applied to the brake product.

3. The brake product of claim 2, wherein the heat treatment comprises a T6 temper.

4. The brake product of claim 3, wherein the T6 temper comprises:

solution treating the brake product at a temperature from 922 degrees Fahrenheit to 942 degrees Fahrenheit for four hours;

water quenching the brake product; and artificially aging the brake product at a temperature from 346 degrees Fahrenheit to 366 degrees Fahrenheit for five hours.

5. The brake product of claim 4, wherein the solution treating is performed at 932 degrees Fahrenheit.

6. The brake product of claim 4, wherein the artificially aging is performed at 356 degrees Fahrenheit.

7. The brake product of claim 1, wherein the iron is greater than 0.12 percent of its weight, but less than or equal to 1.3 percent of its weight.

8. The brake product of claim 1, wherein the brake product is a master cylinder.

9. The brake product of claim 1, wherein the brake product is an ABS component.

10. A braking system comprising:

a brake component, wherein the brake component is made from an ADC12 aluminum alloy and wherein the ADC12 aluminum alloy is cast into the brake component according to a high pressure, slow velocity casting technique;

wherein the ADC12 alloy consists essentially of:

| | |
|---|---|
| 9.6 to 12.0 | percent silicon; |
| 0.0 to 1.3 | percent iron; |
| 0.0 to 0.5 | percent manganese; |
| 0.0 to 0.3 | percent magnesium; |
| 0.0 to 1.0 | percent zinc; |
| 0.0 to 0.5 | percent nickel; |
| 0.0 to 0.3 | percent tin; |
| 1.5 to 3.5 | percent copper; |
| 0.0 to 0.15 | percent one or more other elements; and aluminum as the remainder; |

9.6 to 12.0 percent silicon; 0.0 to 1.3 percent iron; 0.0 to 0.5 percent manganese; 0.0 to 0.3 percent magnesium; 0.0 to 1.0 percent zinc; 0.0 to 0.5 percent nickel; 0.0 to 0.3 percent tin; 1.5 to 3.5 percent copper; 0.0 to 0.15 percent one or more other elements; and aluminum as the remainder; and wherein the brake component has a tensile strength of about 55–61 ksi.

11. The braking system of claim 10, wherein the component is a master cylinder.

12. The braking system of claim 10, wherein the component is an ABS component.

13. The braking system of claim 10, wherein a heat treatment is applied to the brake component.

14. The braking system of claim 13, wherein the heat treatment is a T6 temper.

15. The braking system of claim 14, wherein the T6 temper comprises:

solution treating the aluminum alloy product at a temperature from 922 degrees Fahrenheit to 942 degrees Fahrenheit for four hours;

water quenching the aluminum alloy product; and artificially aging the aluminum alloy product at a temperature from 346 degrees Fahrenheit to 366 degrees Fahrenheit for five hours.

16. The braking system of claim 15, wherein the solution treating is performed at 932 degrees Fahrenheit.

17. The braking system of claim 15, wherein the artificially aging is performed at 356 degrees Fahrenheit.

18. The braking system of claim 10, wherein the iron is greater than 0.12 percent of its weight, but less than or equal to 1.3 percent of its weight.

* * * * *